US006793439B1

(12) United States Patent
Arm et al.

(10) Patent No.: US 6,793,439 B1
(45) Date of Patent: Sep. 21, 2004

(54) SECURING DEVICE FOR A DRAINAGE CHANNEL

(75) Inventors: Wolfgang Arm, Rickert (DE); Brunhild Schmidtke, Koenigsbach (DE); Markus Blaschke, Fockbek (DE)

(73) Assignee: ACO Severin Ahlmann GmbH & Co. KG, Rendsburg (DE)

( * ) Notice: Subject to any disclaimer, the term of this patent is extended or adjusted under 35 U.S.C. 154(b) by 0 days.

(21) Appl. No.: 09/821,470

(22) PCT Filed: Oct. 6, 1999

(86) PCT No.: PCT/EP99/07468

§ 371 (c)(1),
(2), (4) Date: Sep. 24, 2001

(87) PCT Pub. No.: WO00/22247

PCT Pub. Date: Apr. 20, 2000

(30) Foreign Application Priority Data

Oct. 9, 1998 (DE) ..... 198 46 668

(51) Int. Cl.[7] ..... E02B 11/00
(52) U.S. Cl. ..... 405/43; 24/297
(58) Field of Search ..... 405/43, 36, 42, 405/124, 118; 404/25, 26; 52/19, 20, 21; 24/292, 293, 294, 295, 296, 297, 519, 520, 570, 571, 545, 564, 711.1, 453, 456, 457, 458, 573.09, 572.1, 581.1, 581.11, 594.1, 594.11, 573.11, 593.1

(56) References Cited

U.S. PATENT DOCUMENTS 4,382,414 A * 5/1983 Svirklys ..... 24/294
4,621,939 A * 11/1986 Thomann et al. ..... 404/26
4,844,655 A * 7/1989 Aleshire ..... 405/36
4,907,923 A * 3/1990 McGrath, Jr. ..... 411/908
5,201,151 A 4/1993 LeBlanc et al.
5,267,125 A * 11/1993 Liu ..... 24/293
5,328,294 A * 7/1994 Miller ..... 404/25
5,468,096 A 11/1995 Sauerwein et al.
5,647,689 A * 7/1997 Gunter ..... 405/36
6,027,283 A * 2/2000 Schweinberg et al. ..... 405/42

FOREIGN PATENT DOCUMENTS

DE 42 41 707 6/1994
GB 2 260 355 4/1993

* cited by examiner

*Primary Examiner*—Michael Safavi
(74) *Attorney, Agent, or Firm*—Oblon, Spivak, McClelland, Maier & Neustadt, P.C.

(57) ABSTRACT

A securing device for a drainage channel with a channel body, including a cover that can be set onto an upper edge of the channel body. At least two recesses are situated substantially opposite one another in the inner surfaces of the side walls of the channel body. At least one traversing element in the form of an elongated, profiled plate, can be set into the recesses by way of its opposed ends in such a way that it is within the channel and substantially perpendicular to the long axis thereof, and which is provided with a locking element at at least one of its two longitudinal ends. The locking element is an exchangeable, recesses by way of its opposed ends in such a way that it is within the channel and substantially perpendicular to the long axis thereof, and which is provided with a locking element at at least one of its two longitudinal ends. The locking element is an exchangeable, wedge-shaped locking clip with a catching and/or clamping action, which is mounted on the plate and can be moved between installation and stopping positions.

18 Claims, 3 Drawing Sheets

SECURING DEVICE FOR A DRAINAGE CHANNEL

The invention relates to a securing device for a drainage channel as well as to a traversing element and a locking clip for such a securing device.

The patent DE 42 41 707 discloses a securing device for a drainage channel in which a traversing element can be put in place so that its ends lie within recesses in the inner surfaces of the side walls of a channel.

The traversing element is oriented perpendicular to the long axis of the channel in the interior of the channel and comprises attachment devices by means of which to attach a cover to the traversing element and thus to the channel.

The traversing element described in DE 42 41 707 comprises a clamping device that is elastically deformable in such a way that during insertion into the recesses in the channel, it is deformed by the insertion movement of the traversing element. The clamping device here consists of a clamping spring made either of plastic or of a band of stainless steel. By means of such a device the traversing element can be set into the drainage channel in a simple manner, but it presents severe disadvantages, because an attachment system of this kind is expensive to manufacture; the reason is that, in particular in the case of channels with large inside width, a plastic component does not have the necessary stability, so that spring band stainless steel, which is extremely cost-intensive, must be used instead. Furthermore, the geometry of the attachment device described in that patent document requires a considerable amount of material, which in addition reduces the flow cross section in flat channel systems. Another problem is that when the traversing element according to the teaching described in DE 42 41 707 is installed, a spring pressure is exerted on the side walls of the channel, which can impair their stability, in particular in the case of small-sized channels. It is ultimately difficult to position the traversing element precisely, because when it is being inserted it is necessary to work against the increasing spring force of the attachment device. If the position of the traversing element needs to be corrected, the force needed to take the traversing element out of the recesses in the channel is actually substantially greater that that needed to insert it.

The objective of the present invention is to make available a further developed securing device for a drainage channel in which, firstly, less material is required and, secondly, a less expensive material can be used, such that furthermore the flow cross section in channel systems is not substantially reduced.

This objective is achieved with a device according to the present invention, which can include a traversing element and a special locking clip.

An essential idea of the invention is that the traversing element can be placed effortlessly and without any substantial use of force in precisely the predetermined position. only after this has been accomplished is the traversing element in accordance with the invention fixed in that position by pressing or striking lightly on a locking clip disposed on the traversing element. Because during this procedure the traversing element is guided and/or held within the recesses in the channel body, a change of position during the fixation process is practically ruled out.

Another essential aspect of the present invention consists in the design of the locking element as an exchangeable wedge-shaped locking clip or expanding slide, which is movably disposed on the traversing element or plate in such a way that it is possible to shift it between an installation and a stopping position. According to this position—the installation state or the stopping state—the plate and the locking clip cooperate in a catching and/or clamping manner so that the locking clip is fixed to the plate and cannot be lost unless action is taken to produce an intentional removal of the clip.

In accordance with the invention the plate can be inexpensively made of a relatively small amount of stainless steel, because of the advantageous geometry of the plate. Alternatively, the plate can be made of another material that is inert with respect to the medium flowing in the channel, This material can, for example, be a simple or passivated metal, wood or plastic, in particular hardened plastic. The locking clip itself is preferably made of plastic.

Because of its simple geometry, the plate can be manufactured as a simple pressed component, a single piece of a single material. The combination of several components or materials is not necessary.

To assist mounting of the channel cover the plate is preferably provided with an aperture which, when the plate has been installed, is substantially in the middle on the upper surface of the plate. Attachment of the cover to the traversing element is preferably brought about by the method described in DE 42 41 706 and DE 42 41 707. These methods represent a preferred embodiment, but other kinds of attachment are also conceivable, such as a clamp that encloses the traversing element or the plate at the sides.

In the following the invention is explained with reference to an exemplary embodiment and to drawings, wherein FIG. 1 is a plan view of a plate set into a channel and stopped;

In the following description, the same reference numerals are used for identical parts or parts with identical actions.

Figure 1:
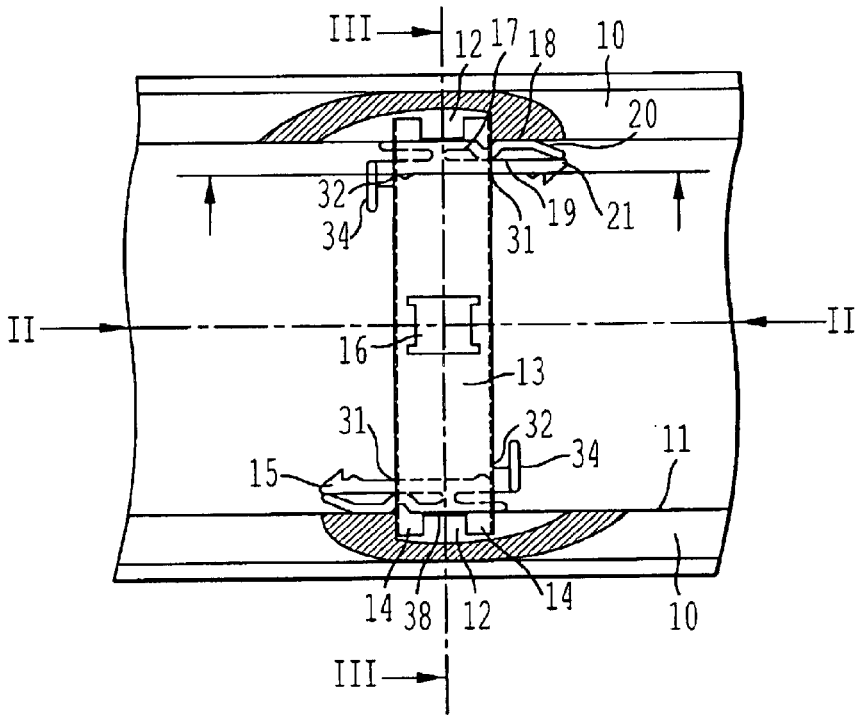

FIG. 1 shows part of a channel body which on the inner surface of its side walls 11 comprises recesses 12 into which the ends 14 of a plate 13 have been inserted. The plate 13 has an elongated, profiled configuration and at each of its opposite ends is stopped against the inner side wall 11 of the channel body 10 by means of a locking clip 15. The plate 13 further comprises an attachment aperture 16 disposed substantially in the middle of the upper surface of the plate 13.

As can be seen in FIG. 1, each of the two locking clips 15 is in its stopped position. In this stopped position a wedge limb 17 comprising a bearing surface 18 and a bead 19 is so disposed that the bearing surface 18 is in clamping contact with the inner side wall 11 of the channel body 10. The wedge limb 17, by way of its bead 19 and an end section 20, is pressed against a stopping limb 21 so strongly that a clamping action between the bearing surface 18 and the inner side wall 11 of the channel body 10 is produced. For reliable positioning of the locking clip 15 and the clip is guided through an opening situated in the opposite long sides 23 of the profile 13. This opening 22 has a cross-sectional shape that corresponds substantially to the cross-sectional shape of the locking clip 15. The inner width of the opening 22 hence corresponds substantially to the cross-sectional extent of the locking clip 15 when it is under tension, i.e. compressed.

The locking clip 15 is so shaped that it can easily, with little expenditure of force, be pressed into the opening 22 in the plate 13; in the process, the wedge limb 17 is pressed lightly against its stopping limb 21, so that the bead 19 and the end section 20 of the wedge limb come into contact with the stopping limb 21. In this way a clamping action of the locking clip 15 in the opening 22 is ensured.

Figure 4:
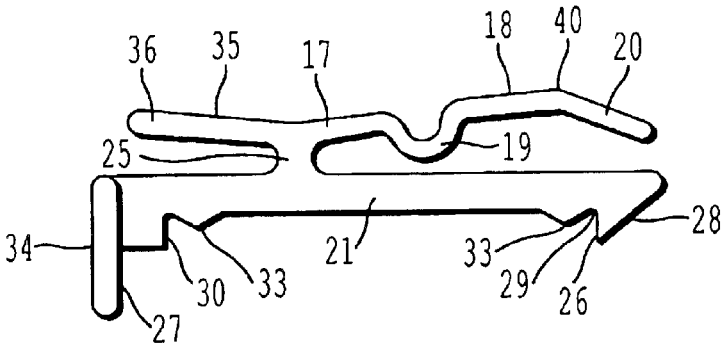
FIG. 4 is a side view of a locking clip.

In FIG. 4 a locking clip 15 is shown in detail. The locking clip is substantially H-shaped It has a resilient, springy central bridge 25 that allows the two opposed limbs of the HR to change position with respect to one another, as well as a wedge limb 17 with a first bearing surface 18 and a bead 19, which is braced against an opposed stopping limb 21. The stopping limb 21 comprises at one end a first positioning abutment 26 and at another end a second positioning abutment 27.

The wedge limb 17 further comprises a wedge-limb end section 20, which is angled toward the stopping limb 21. The region of the stopping limb opposite the end section 20 comprises a slide chamfer 28 which, in cooperation with the end section 20 of the wedge limb, makes it easier to push the locking clip 15 into the opening 22. After the locking clip 15 has been pressed into the opening 22, a first notch 29 associated with the first positioning abutment 26 snaps over a first inner edge 31 of the opening and thus fixes the locking clip 15 in its installation position.

When the locking clip 15 is moved into the stopping position, the locking clip 15 slides through the opening 22 until a second notch 30 snaps against a second inner edge 32 of the opening. This engagement, by snapping or catching of the second opening edge 32 into the second notch 30, ensures that the locking clip 15 is securely and immovably fixed in its stopping position. To prevent unintended release of the locking clip 15 from its installation or its stopping position, the first notch 29 and the second notch 30, respectively, are each adjoined by a lug 33 over which the first opening edge 31 or the second opening edge 32, respectively, must be pushed. In order that the pressure required for this purpose can be applied to the locking clip 15, an impact surface 34 is disposed on the stopping limb at its end opposite the slide chamfer.

The plate 13 is installed accordingly, by first inserting its ends into the recesses 12 in the inner side wall 11 of the channel body 10; at this stage the locking clips 15 are in their installation position. After the plate 13 has been correctly positioned, a tool such as a hammer is used to strike lightly the impact surface 34 of the locking clip 15, as a result of which the first inner edge 31 of the opening is knocked out of the first notch 29, over the lug 33, and the locking clip 15 slides through the opening 22 until the second inner edge 32 of the opening slips over the opposite lug 33 and is caught in the second notch 30. The locking clip 15 is now in its stopping position.

To ensure that the locking clip 15 cannot be dislodged from its stopping position by vibration, shaking, vehicles passing over the cover of the channel body 10 and the like, opposite the second abutment 27 is a limb that forms a continuation of the wedge limb and comprises a second bearing surface 35.

As can be seen in FIG. 4, the limb 36 and the wedge limb 17 are disposed at an angle to the central bridge 25 that is somewhat more obtuse than 90°, so that both limbs 36 and 17 become further away from the stopping limb at progressively greater distances from the bridge. Now when the second inner edge 32 of the opening engages the second notch 30, at the same time the increased distance of the limb 36 from the stopping limb 21 causes the locking clip 15 to exert a clamping action within the opening 22. This clamping action, together with the lug 33 and the clamping action of the bearing surface 18 against the inner side wall 11 of the channel body, which is brought about when the bead 19 and the end section 20 of the wedge limb come into contact with the stopping limb 21, reliably prevents the locking clip from being unintentionally released from the stopping position.

However, when it is intended to move the locking clip 15 out of the stopping position, it suffices to use an appropriate tool. The locking clip 15 then slides back into its installation position, in a reversal of the previously described process, and the first inner edge of the opening 31 catches in the first notch 29. In this way the plate 13 can be removed from the channel body 10 by releasing the locking clip 15.

According to one embodiment the plate 13 comprises an opening 22 to receive the locking clip 15 on each of the two opposed long sides of the profile, so that the plate 13 can be fixed within the channel body 10 by the stopping action of two locking clips 15.

According to another embodiment the plate 13 has only one opening 22 on one of the long sides 23 of the profile 13, whereas on the opposite side a thrust-bearing toe is situated.

This thrust-bearing toe 37 supplements in terms of force the locking clip 15 on the other side of the plate 13.

According to another embodiment a tongue is stamped out at ends 14 of the plate, on one side or preferably on both sides, and is bent so that it comes to bear against the part of the inner side wall 11 adjacent to the recess 12 in the channel body 10 when the plate 13 is set into the channel body 10. By means of these tongues 38, positioning of the plate 13 in the channel body 10 is simplified. The tongues 38 are disposed at the level of an outer opening edge 39 so as to ensure that the bearing surface 18 of the locking clip 15 can come into clamping engagement with the inner side wall 11 of the channel body 10. This is is evident in particular from FIGS. 1, 3, 6 and 7.

Figure 2:
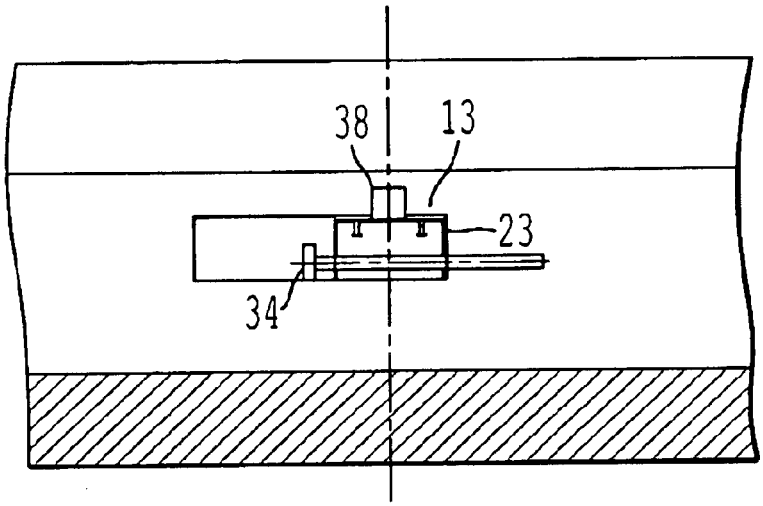
FIG. 2 shows a cross section of the installed plate shown in FIG. 1. along the line II-II.
Figure 3:
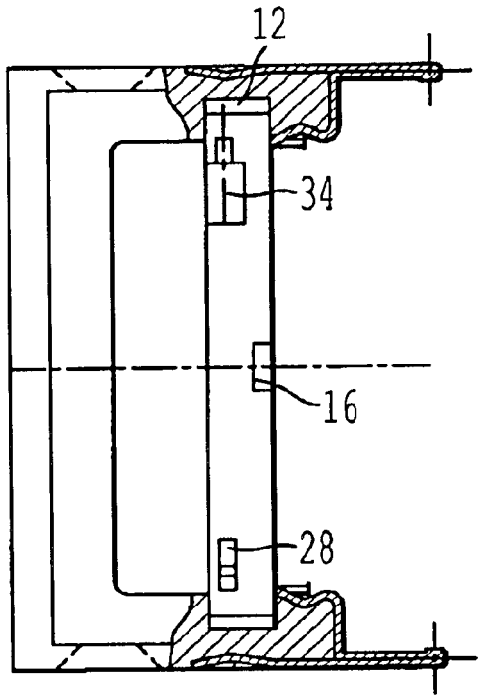
FIG. 3 shows a cross section of the installed plate shown in FIG. 1, along the line III-III.
Figure 5:
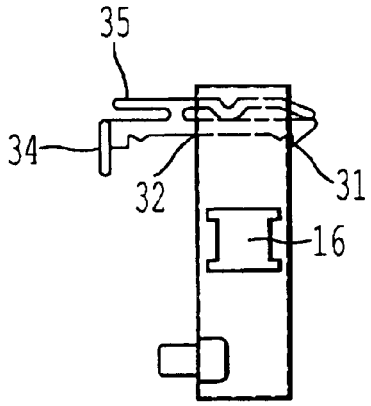
FIG. 5 is a plan view of a plate with a locking clip in the installation position and a thrust-bearing toe.
Figure 6:
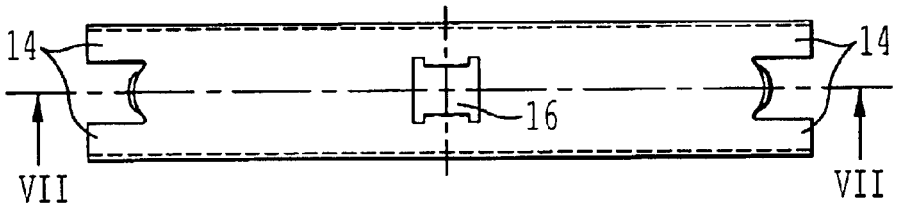
FIG. 6 is another plan view of a plate.
Figure 7:
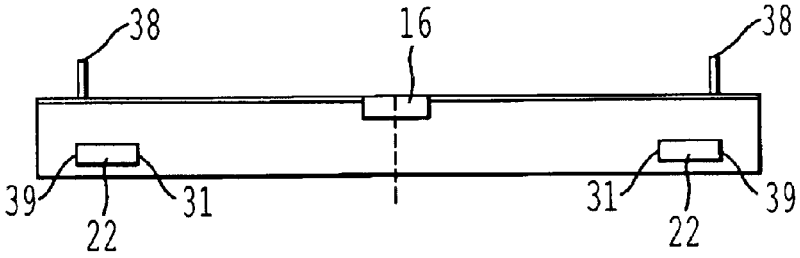
FIG. 7 is a side view of the plate in FIG. 6 along the line VII-VII.

In FIG. 2 it is again shown clearly how the locking clip 15 is disposed in its stopping position, passing through the openings 22 in the plate 13. To ensure that the locking clip 15 can be effortlessly inserted into the opening 22 in the plate 13, the wedge limb 17 is provided in the direction of its end section 20 with a bend 40, so that the end section 20 acts together with the slide chamfer 28 to facilitate insertion.

The plate 13 is preferably so constructed that when in the installed state, in cooperation with the locking clip 15 it produces a coaxial stiffening of the channel body 10.

Preferably a locking clip of the kind described above is used to fix the plate 13 within the channel body, but the locking clip can also be constructed in the form of a rotating lock, expansion bolt, drop latch or spring bar.

As can be inferred from the preceding, the securing device in accordance with the invention and in particular the plate 13 in accordance with the invention in cooperation with the locking clip 15 is suitable for the attachment of covers to channel bodies 10; in particular the easy installation and removability of the plate 13, for example in order to clean the channel body 10, represent preferred and especially advantageous characteristics. The locking clip remains connected to the plate so that it cannot be lost even when the plates are removed in order to clean the channel body.

LIST OF REFERENCE NUMERALS

10 Channel body
11 Inner surface of side wall
12 Recess
13 Plate

14 Ends (of the plate)
15 Locking clip
16 Attachment aperture
17 Wedge limb
18 First bearing surface
19 Bead
20 End section of wedge limb
21 Stopping limb
22 Opening
23 Long sides
13 Profile
25 Central bridge
26 First positioning abutment
27 Second positioning abutment
28 Slide chamfer
29 First notch
30 Second notch
31 First inner edge of opening
32 Second inner edge of opening
33 Lug
34 Impact surface
35 Second bearing surface
36 Limb
37 Thrust-bearing toe
38 Tongue
39 Outer edge of opening
40 Bend

What is claimed is:

1. A securing system for a drainage channel, comprising:

a channel body having at least two recesses formed substantially opposite one another in inner surfaces of the channel body;

a cover detachably set onto an upper opening portion of the channel body;

a plate having at least one opening formed therein, an attaching device configured to attach the cover, and a plurality of longitudinal end portions fitted in the at least two recesses of the channel body such that the plate is positioned across the channel body; and at least one exchangeable locking clip removably inserted in the at least one opening of the plate and configured to clamp the plate onto the channel body, wherein the at least one exchangeable locking clip has a wedge shape, has an elastically resilient central bridge by which opposed limbs of the wedge shape are moveable to change position relative to one another, a wedge limb with a first bearing surface and a bead, which is braced against an opposed stopping limb that comprises, at one end, a first positioning abutment and at another end a second positioning abutment.

2. A securing system according to claim 1, wherein the bead and an end portion of the wedge limb prior to fixation of the at least one exchangeable locking clip within the plate are spaced apart from the opposed stopping limb and are not under tension.

3. A securing system according to claim 1, wherein the bead and an end portion of the wedge limb after fixation of the at least one exchangeable locking clip within the plate are at first lightly, and after installation of the plate in the channel body are strongly pressed against the opposed stopping limb.

4. A securing system according to claim 1, wherein an end portion of the wedge limb comprises a bend such that an end section of the wedge limb extends toward the opposed stopping limb.

5. A securing system according to claim 1, wherein said opposed stopping limb in a region opposite an end section of the wedge limb comprises a slide chamfer.

6. A securing system according to claim 5, wherein the opposed stopping limb comprises, at an end portion opposite the slide chamfer, an impact surface.

7. A securing system according to claim 1, wherein the at least one opening has a cross-sectional shape that corresponds substantially to the cross-section of the at least one exchangeable locking clip.

8. A securing system according to claim 7, wherein an inner width of the at least one opening corresponds substantially to the cross-section extent of the at least one exchangeable locking clip when under tension.

9. A securing system according to claim 1, wherein the at least one exchangeable locking clip is configured to be fixed within the at least one opening by the first and second positioning abutments.

10. A securing system according to claim 1, wherein the at least one exchangeable locking clip comprises a second bearing surface on a limb that is opposite the second positioning abutment.

11. A securing system according to claim 1, wherein the plate is fixed by the at least one exchangeable locking clip in such a way that the plate is secured against unintended rotation, linear displacement and release.

12. A securing system according to claim 1, wherein the plate is configured to be released from a fixed position by unclamping the at least one exchangeable locking clip.

13. A securing system according to claim 1, wherein the plate further comprises a plurality of locking clips provided at longitudinal ends thereof.

14. A securing system according to claim 1, wherein the at least one exchangeable locking clip is provided at only one end of the plate, and the plate further comprises a thrust-bearing toe provided at the other end of the plate.

15. A securing system according to claim 1, wherein the plate further comprises a tongue which is stamped out and bent by substantially 90° so as to form a lateral bearing surface against the inner surfaces of the channel body.

16. A securing system according to claim 1, wherein the plate is made of stainless steel.

17. A securing system according to claim 1, wherein the at least one exchangeable locking clip is made of plastic.

18. A securing system according to claim 1, wherein the plate and the at least one exchangeable locking clip are installed in the channel body such that the plate and the at least one exchangeable locking clip provide a coaxial stiffening of the channel body.

* * * * *